US011313164B2

(12) United States Patent
Bendefy

(10) Patent No.: US 11,313,164 B2
(45) Date of Patent: Apr. 26, 2022

(54) FLAP FITTING

(71) Applicant: Flap Competence Center Kft, Budapest (HU)

(72) Inventor: Andras Bendefy, Budapest (HU)

(73) Assignee: Flap Competence Center Kft, Budapest (HU)

( * ) Notice: Subject to any disclaimer, the term of this patent is extended or adjusted under 35 U.S.C. 154(b) by 70 days.

(21) Appl. No.: 16/838,144

(22) Filed: Apr. 2, 2020

(65) Prior Publication Data

US 2020/0318412 A1 Oct. 8, 2020

(30) Foreign Application Priority Data

Apr. 2, 2019 (EP) ..... 19166867

(51) Int. Cl.
*E05F 5/02* (2006.01)

(52) U.S. Cl.
CPC ..... *E05F 5/02* (2013.01)

(58) Field of Classification Search
CPC ..... E05F 5/02; E05D 15/262; E05Y 2900/20
See application file for complete search history.

(56) References Cited

U.S. PATENT DOCUMENTS 3,773,311 A * 11/1973 Poe ..... E05F 1/1253 267/114
5,882,099 A 3/1999 Salice
7,240,974 B2 * 7/2007 Hirtsiefer ..... E05D 15/262 312/109
7,500,287 B2 * 3/2009 Brustle ..... E05F 1/1075 16/286

(Continued)

FOREIGN PATENT DOCUMENTS

AT 516784 8/2016
CN 101438022 5/2009

(Continued)

OTHER PUBLICATIONS

Office Action issued in corresponding JP Application No. 2020060786, dated Mar. 30, 2021.
Office Action issued in Chinese counterpart Application No. 2020102107386 dated Jul. 2, 2021.

*Primary Examiner* — Victor D Batson
*Assistant Examiner* — Matthew J Sullivan
(74) *Attorney, Agent, or Firm* — Burris Law, PLLC

(57) ABSTRACT

A flap fitting includes a setting arm attached to a base element so as to be pivotable about a setting axis between an open position and a closed position, a toggle lever mechanism having a first lever and a second lever connected to each other pivotably about a pivot axis, and an energy accumulator. The energy accumulator acts on the first lever at a first link point spaced from the pivot axis and on the second lever at a second link point spaced from the pivot axis. Also, the first link point and the second link point are acted upon by the energy accumulator with force towards one another. A setting contour arrangement with a setting contour and a guide element is arranged between the first lever and the setting arm and the guide element is movable along the setting contour. The setting arm is forcedly loaded in the direction of rotation about the setting axis at least in a partial section along the setting contour by the first lever via the setting contour arrangement.

20 Claims, 4 Drawing Sheets

(56) References Cited

U.S. PATENT DOCUMENTS

| | | | | |
|---|---|---|---|---|
| 8,807,670 | B2 * | 8/2014 | Blum | A47B 96/00 312/319.2 |
| 9,187,943 | B2 * | 11/2015 | Leone | E05F 5/10 |
| 9,816,302 | B2 * | 11/2017 | Shepherd | E05D 3/14 |
| 9,834,973 | B2 * | 12/2017 | Tomatsu | E05F 5/02 |
| 10,662,690 | B2 * | 5/2020 | Schluge | E05F 1/1058 |
| 10,704,311 | B1 * | 7/2020 | Collene | E05F 1/1261 |
| 10,829,976 | B2 * | 11/2020 | Bendefy | E05F 1/1083 |
| 11,053,723 | B2 * | 7/2021 | Sobolewski | E05D 15/46 |
| 2005/0218383 | A1 | 10/2005 | Hirtsiefer et al. | |
| 2006/0174444 | A1 * | 8/2006 | Giovannetti | E05D 15/262 16/354 |
| 2015/0084492 | A1 | 3/2015 | Braungart | |
| 2015/0240546 | A1 | 8/2015 | Oshima et al. | |
| 2016/0333620 | A1 | 11/2016 | Holzapfel | |
| 2017/0335611 | A1 | 11/2017 | Brunnmayr | |

FOREIGN PATENT DOCUMENTS

| | | |
|---|---|---|
| CN | 102209828 | 10/2011 |
| CN | 104583518 | 4/2015 |
| CN | 106103873 | 11/2016 |
| DE | 10223026 | 2/2004 |
| DE | 202017101255 | 3/2018 |
| DE | 102018104471 | 9/2018 |
| EP | 2924215 | 9/2015 |
| EP | 3401476 | 11/2018 |
| EP | 3401477 | 11/2018 |
| JP | H0784135 | 3/1995 |
| JP | 2009274552 | 11/2009 |
| WO | 2007132290 | 11/2007 |

* cited by examiner

FLAP FITTING

CROSS-REFERENCE TO RELATED APPLICATIONS

This application claims priority to and the benefit of EP 19166867.2 filed on Apr. 2, 2019. The disclosure of the above application is incorporated herein by reference.

FIELD

The present disclosure relates to a flap fitting.

BACKGROUND

The statements in this section merely provide background information related to the present disclosure and may not constitute prior art.

A flap fitting is known from DE 10 2018 104 471 A1. The flap fitting comprises a mounting bracket fixed to a flap and a toggle lever mechanism pivotably connected to the mounting bracket. The toggle lever mechanism comprises a first setting arm pivotably connected at a free end to the mounting bracket and a drive lever pivotably connected at a free end to a base element of the flap fitting, wherein the first setting arm and the drive lever are connected to each other pivotably about a pivot axis. The drive lever is pivotably connected to a drive arm, which is guided in a slotted link of the base element and is forcedly loaded via a tension spring, so that the lid is forcedly loaded via the first setting arm in the direction towards an open position.

SUMMARY

This section provides a general summary of the disclosure and is not a comprehensive disclosure of its full scope or all of its features.

The present disclosure provides a flap fitting which enables efficient use of installation space and highly variable courses of the setting force.

In one form of the present disclosure, a flap fitting comprises a setting arm which is attached to a base element so as to be pivotable about a setting axis between an open position and a closed position, a toggle lever mechanism with a first lever and with a second lever pivotably connected to each other about a pivot axis, and an energy accumulator. The energy accumulator acts on the first lever at a first link point spaced from the pivot axis and on the second lever at a second link point spaced from the pivot axis. In some variations the first link point and the second link point are forcedly loaded by the energy accumulator towards one another. A setting contour arrangement with a setting contour and a guide element is arranged between the first lever and the setting arm. In at least one variation the guide element can be moved along the setting contour and the setting arm is forcedly loaded from the first lever via the setting contour arrangement in the direction of rotation about the setting axis.

The flap fitting according to the teachings of the present disclosure reduces installation space due to the force transmission of the energy accumulator into the toggle lever mechanism, which is directed towards each other, and that it is particularly flat. Furthermore, a highly variable setting force along the setting contour can be achieved by the force transmission of the energy accumulator into the toggle lever mechanism, which is directed towards each other and which can have a high maximum force in particular.

The flap fitting can be configured in such a way that the setting contour is formed on the first lever and the guide element is arranged on the setting arm at a distance from the setting axis. The setting contour can be located between the pivot axis and the first link point. The setting contour can also be configured as a cam section of the first lever. Alternatively, or in addition to, the setting contour is formed on the setting arm and the guide element is located on the first lever.

The setting contour can have a course such that along the setting contour the setting arm is loaded by the first lever via the guide element in a first section with a force which acts in a positive direction of rotation about the setting axis and/or in a second section with a force which acts in a negative direction of rotation about the setting axis. In addition, in a third section, the setting contour can be configured in such a way that the force with which the setting arm is loaded by the first lever via the guide element acts in the direction of the setting axis, so that no torque acts upon the setting arm.

The distance of the first link point to the pivot axis can be greater than the maximum distance of the setting contour to the pivot axis. According to the resulting lever ratios, the force acting from the energy accumulator onto the toggle lever mechanism is increased so that the force acting from the first lever via the guide element on the setting arm is greater than the spring force. High maximum actuating forces can thus be realized. The ratio of the distance of the first link point to the pivot axis and the distance of the setting contour to the pivot axis can also be configured as to be variable over the course of the setting contour.

The guide element may have a roller which is supported against the setting contour. By rolling the roller along the setting contour, a continuous course of the setting force acting on the setting arm along the setting contour can be realized.

The energy accumulator may include a flat spring. For the purposes of this disclosure, flat springs are defined as springs that are limited on two opposite sides by flat surfaces, each of which has an extension in height and width that exceeds the thickness of the spring multiple times. The flat spring can be made of a flat material. The flat material can be plate-shaped. In other words, the flat material can be a flat piece of material of the same thickness everywhere, limited on two opposite sides by a flat surface which is very extensive in relation to its thickness.

The flat spring can be elastically loaded between the base element and the setting arm in one plane of the flat material. For the purposes of this disclosure, a plane of the flat material is to be understood as all planes that are parallel to at least one of the flat surfaces arranged on the two sides facing away from each other and that lie between these flat surfaces, along the thickness of the flat spring. In other words, the flat spring can be elastically loaded between the base element and the setting arm perpendicular to a thickness of the flat material.

The flat spring can be U-shaped in the plane of the flat material and can form a first leg and a second leg which merge into each other via a turn section. The first leg can be pivotably connected to the base element with a first end and can engage with the first link point of the toggle lever mechanism via the first end. The first end can have a convex partially cylindrical outer surface with which the flat spring is held in sliding contact with a complementarily formed concave partially cylindrical first sliding surface.

The first end of the flat spring may be arranged non-displaceable relative to the base element in a direction perpendicular to the connection between the first link point and the second link point. For this purpose, the first end can, for example, be rotatably mounted on a pin firmly connected to the base element or the first end of the flat spring can engage form-fittingly in a recess in the base element.

The second leg may have a second end that engages the second link point of the toggle lever mechanism. The second leg can be guided linearly adjustable on the base element. The base element may have a plane second sliding surface against which the second end is held in sliding contact. For this purpose, a sliding element can be arranged between the base element and the second end.

Between the first lever and the second lever of the toggle lever mechanism an angle can be formed, always between the open position and the closed position, which is oriented in the direction towards the second sliding surface and is in particular less than 180 degrees. This provides that a resulting torque is acting on the flat spring so that the second end is held in sliding contact against the second sliding surface. The flat spring is thus free and statically determined mounted in the base element always between the open position and the closed position.

The toggle lever mechanism can be freely and statically determined mounted with the first link point and the second link point between the first end and the second end of the flat spring and the guide element. This results in a compact design and easy installation of the flap fitting.

Alternatively, the energy accumulator can be configured as a flat spring, which is S-shaped, W-shaped, wave-shaped or grid-shaped in the plane of the flat material.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
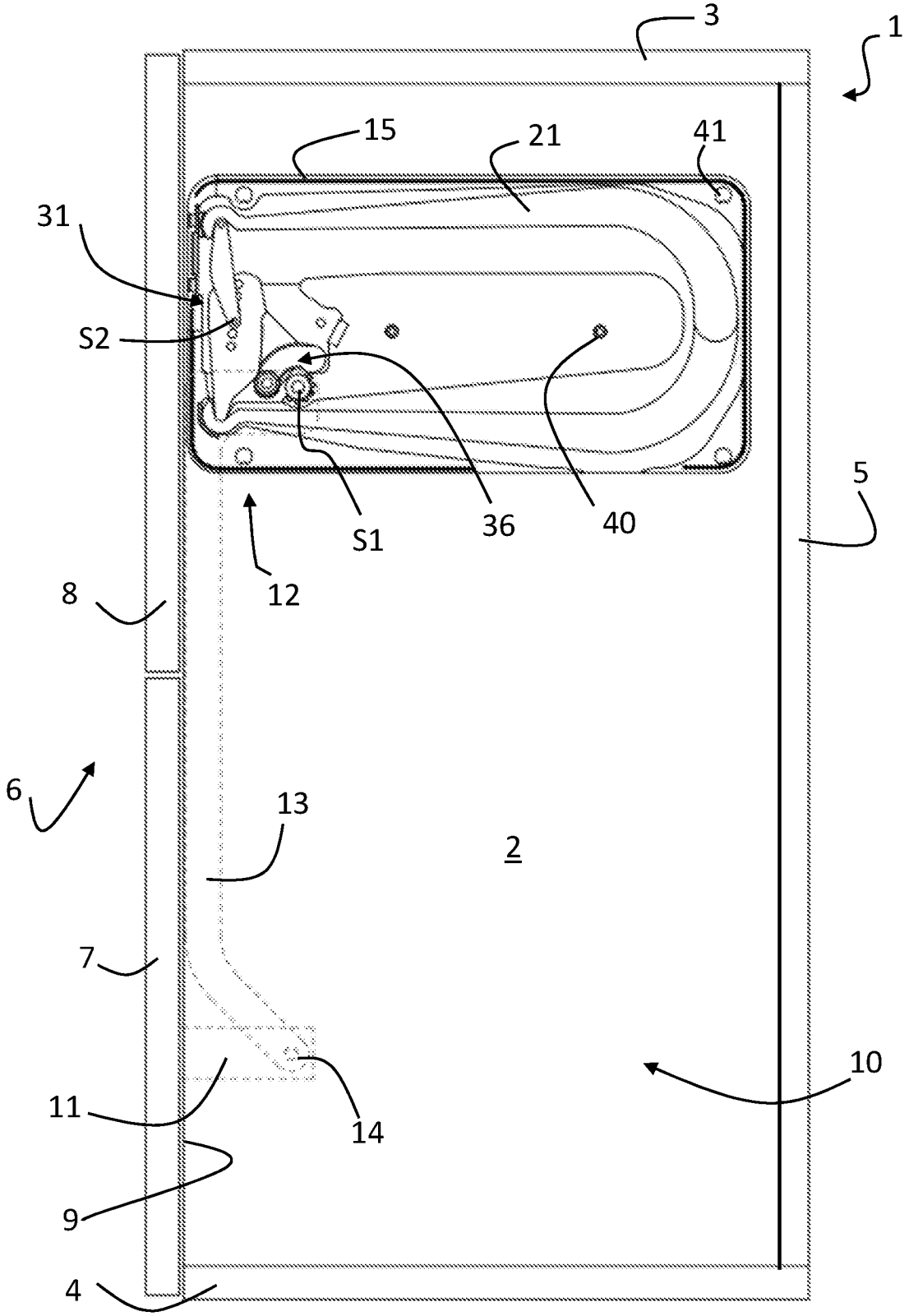
FIG. 1 shows a side view of a furniture with a flap fitting in a closed position in a sectional view.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
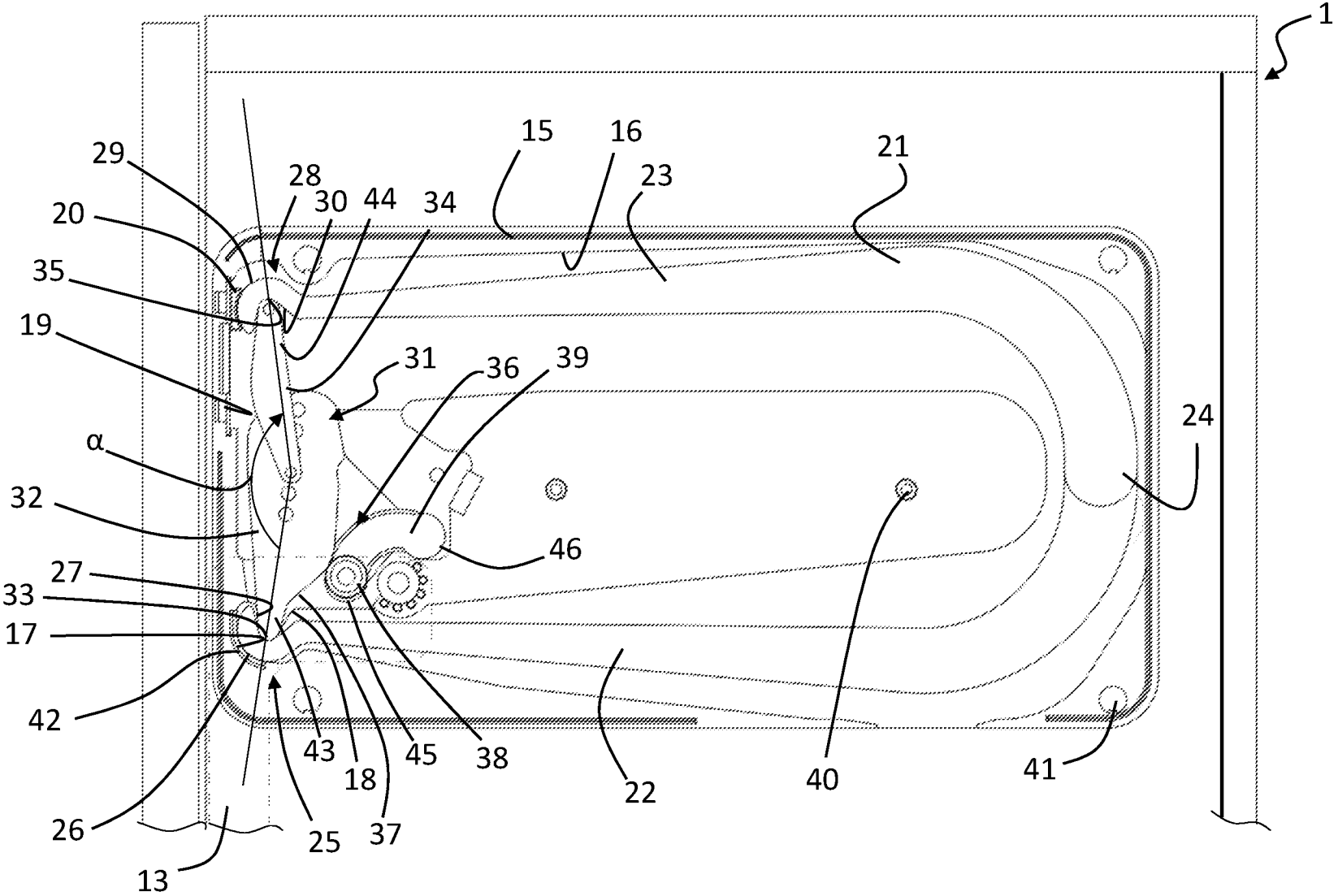
FIG. 2 shows a detailed view of the flap fitting of the furniture from FIG. 1.

FIGS. 1 and 2, which are described together below, show a piece of furniture 1 (also referred to herein simply as "furniture") with a flap fitting 12 with a flap 6 in a closed position. The furniture 1 comprises a side panel 2, a top panel 3, a bottom panel 4 and a rear panel 5 which, together with a second side panel not shown in FIGS. 1 and 2, define an interior space 10 of furniture 1. The interior 10 of furniture 1 is accessible via an opening 9. The opening 9 is closed by flap 6, which is hinged at one end to the top panel 3 of furniture 1 with a hinge not shown. In the present case, flap 6 comprises a lower flap element 7 and an upper flap element 8, which are connected to each other approximately in the middle of flap 6 by another hinge not shown.

A fitting element 11 is fixedly connected to the lower flap element 7. The fitting element 11 serves as a connecting element between the flap 6 and a flap fitting 12. The flap fitting 12 comprises a setting arm 13, which is connected at one end via a connection arrangement 14 to the fitting element 11 and at an opposite end to a base element 15 of the flap fitting 12 so as to be rotatable about a setting axis S1. The base element 15 has an extension in the height and width direction corresponding to a multiple of the thickness of the base element 15. The base element 15 can be connected to the side panel 2 via fastening elements 40. For the sake of clarity, FIGS. 1 to 4 show base element 15 without a cover plate, which can be attached to base element 15 via locating bores 41. The base element 15 has a recess 16 in which a spring element 21 is accommodated.

The spring element 21 in the present case is configured as a U-shaped flat spring and comprises a first leg 22 and a second leg 23, which are connected to each other via a turn section 24.

A first end 25 of the first leg 22 is hook-shaped and has a convex, partially cylindrical outer surface 26, which is in contact with a first sliding surface 17 of the base element 15, which is complementary to the outer surface 26. The first sliding surface 17 is formed in the present case by a sliding bearing element 42, which is inserted into the base element 15. The first end 25 of the first leg 22 also has a concave, partially cylindrical inner surface 27, which is in contact with a complementarily configured securing section 18 of the base element 15. The first end 25 of the first leg 22 is received between the first sliding surface 17 and the securing section 18, so that the spring element 21 is mounted at the first end so that it can rotate and is axially non-displaceable relative to the base element 15. The first sliding surface 17 and the securing section 18 of the base element 15 thus act as pivot bearings for the spring element 21. It is also conceivable that the spring element 21 is mounted with the first end 25 of the first leg 22 via an alternative pivot bearing, for example via a roller bearing or bolt element, on the base element 15.

A second end 28 of the second leg 23 is hook-shaped and has a convex, partially cylindrical outer surface 29, which is linearly slidingly supported on a second sliding surface 19 of the base element 15. In at least one variation, the partially cylindrical outer surface 29 is linearly slidingly supported with a sliding element 20 arranged between the outer surface 29 of the second end 28 and the second sliding surface 19 of the base element 15. The second end 28 of the second leg 23 also has a concave, partially cylindrical inner surface 30, which is in contact with a toggle lever mechanism 31.

The toggle lever mechanism 31 comprises a first lever 32 and a second lever 34, which are connected to each other so as to be rotatable about a pivot axis S2. The first lever 32 has a first link section 43, on which the spring element 21 with the concave, partially cylindrical inner surface 27 of the first end 25 engages at a first link point 33. The second lever 34 has a second link section 44, where the spring element 21 with the concave, partially cylindrical inner surface 30 of the second end 28 engages at a second link point 35. Alternatively, it is also conceivable that the spring element 21 acts on the toggle lever mechanism 31 via a pin section of the first lever 32 and/or via a pin section of the second lever 34.

The toggle lever mechanism 31 is inserted under pre-load into spring element 21, so that the first link point and the second link point are loaded by spring element 21 towards each other with the spring force.

The first lever 32 and the second lever 34 are arranged at an angle α to each other, which is oriented towards the second sliding surface 19 of the base element 15, and opens in this direction. In the closed position shown in FIGS. 1 and 2, the angle α is less than 180°, in the present case approximately 160°. A force component is thus acting on the second end 28 of spring element 21, which causes spring element 21 to rotate about the first link point 33 in a positive direction of rotation in relation to pivot axis S2. In the illustrations of FIGS. 1 and 2, the positive direction of rotation corresponds to an anti-clockwise rotation. Due to the rotation of the spring element 21 in the positive direction of rotation, the second end 28 comes into contact with the second sliding surface 19 via the sliding element 20 and is supported against it. The spring element 21 is thus mounted freely and statically determined in the base element 15.

The spring force of the spring element 21 is transmitted to the first lever 32 via the second lever 34 on the pivot axis S2, wherein the force acting on the first lever 32 has a component opposite to the opening of the angle α. In the present case, this force component acts in such a way that the first lever 32 rotates about the first link point 33 in a negative direction of rotation relative to the pivot axis S2. In the illustrations of FIGS. 1 and 2 the negative direction of rotation corresponds to a clockwise rotation.

The first lever 32 has a setting contour 37, with which the first lever 32 is supported against a guide element 38. The setting contour 37 and the guide element 38 are therefore elements of a setting contour arrangement 36. The setting contour 37 is located on the first lever 32 between the pivot axis S2 and the first link point 33. The guide element 38 has a roller which is rotatably connected to the setting arm 13 and is guided in a slotted link 39 in the base element 15. Alternatively, it is also conceivable that the guide element is arranged on the first lever and the setting contour is formed on the setting arm 13.

In the closed position shown in FIGS. 1 and 2, the setting contour 37 is in contact with the guide element 38 in such a way that the resulting force between the setting contour 37 of the first lever 32 and the guide element 38 exerts a torque to the setting arm 13 positive about the setting axis S1, i.e. a torque acting in a positive direction of rotation. The positive torque acting on the setting arm 13 moves the setting arm 13 in the direction towards the closed position. In the present case, the positive torque rotates the setting arm 13 about the actuator axis S1 away from the opening 9 of the furniture 1 towards the interior 10.

The distance between the first link point 33 and the pivot axis S2 is greater than the distance between the first link point 33 and the contact point between the setting contour 37 of the first lever 32 and the guide element 38. The force exerted by the spring element 21 via the second lever 34 on the first lever 32, by which a torque is applied to the setting arm 13, is thus increased in accordance with the lever principle so that a high maximum setting force acting on the setting arm 13 can be achieved.

The closed position is defined by a first stop 45 in the slotted link 39, against which the guide element 38 abuts in the closed position, so that the rotation of the setting arm 13 around the actuator axis S1 is limited. However, it is also possible that the closed position is defined by the abutment of flap 6 against at least one of the elements side panel 2, top panel 3 and bottom panel 4 of furniture 1.

Figure 3:
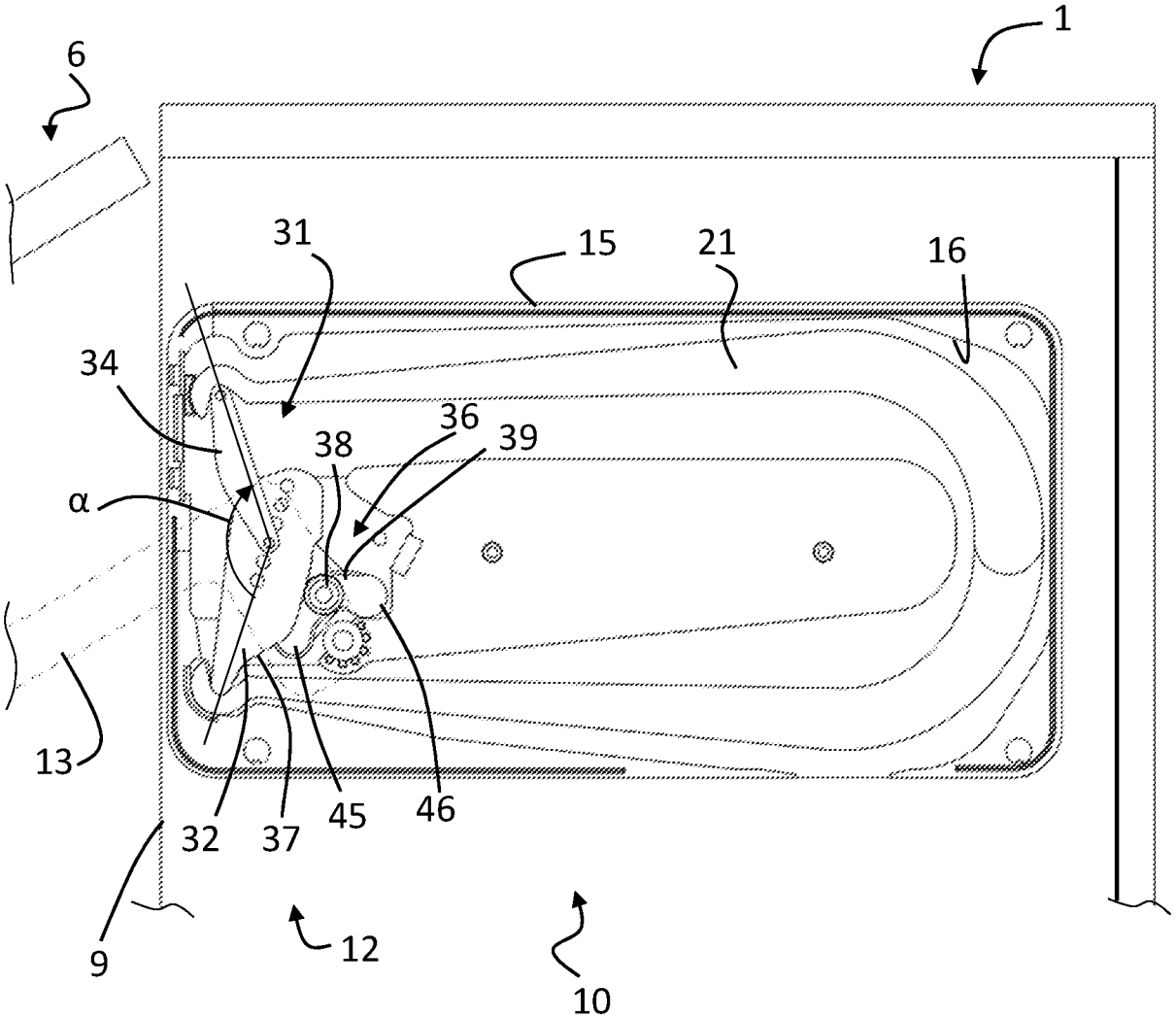
FIG. 3 shows a side view of the furniture from FIG. 1 with the flap fitting in an intermediate position in a sectional view.

FIG. 3 shows the furniture 1 with the inventive flap fitting 12 in an intermediate position between the closed position and the open position. Compared to the closed position, the setting arm 13 is pivoted around the setting axis S1 towards the opening 9 of the furniture in the intermediate position. The guide element 38 has accordingly moved by the same angular amount in the slotted link 39 of the base element 15. In the intermediate position, the setting contour 37 of the first lever 32 is in contact with the guide element 38 in such a way that the resulting force between the setting contour 37 of the first lever 32 and the guide element 38 exerts a negative torque about the setting axis S1 to the setting arm 13, i.e. a torque acting in the negative direction of rotation. The negative torque acting on the setting arm 13 moves the setting arm 13 away from the closed position towards an open position. In the present case, the negative torque rotates setting arm 13 about the actuator axis S1 away from the interior of furniture 1. If the setting arm 13 is thus brought into an intermediate position, for example by lifting the lower flap element, the setting arm 13 continues to rotate in the direction towards an open position.

Figure 4:
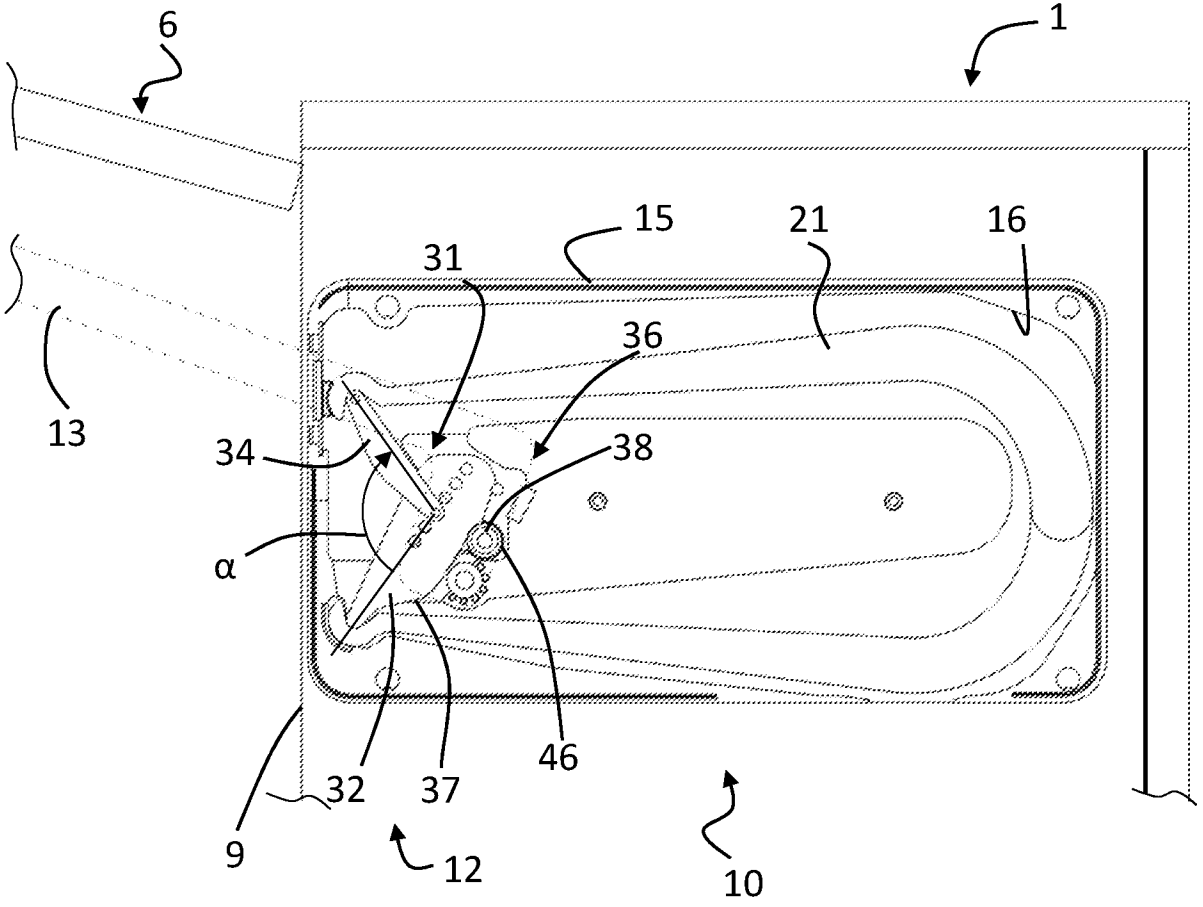
FIG. 4 shows a side view of the furniture from FIG. 1 with a flap fitting in the open position in a sectional view.

FIG. 4 shows furniture 1 with the flap fitting 12 in an open position. Compared to the closed position, the setting arm 13 is pivoted around the setting axis S 1 towards the opening 9 of the furniture. The guide element 38 has accordingly moved by the same angle in the slotted link 39 of the base element 15 and is in contact with a second stop 46 of the slide slotted link 39. The setting arm 13 can therefore no longer rotate in negative direction. In the open position, the setting contour 37 of the first lever 32 is in contact with the guide element 38 in such a way that the resulting force between the setting contour 37 of the first lever 32 and the guide element 38 continues to apply a negative torque to the setting arm 13 about the setting axis S1, so that the setting arm 13 does not rotate in the direction of a positive torque and remains in the open position. The negative torque acting on the setting arm 13 in the open position is selected to be greater than a positive torque acting on the setting arm 13 resulting from the weight of flap 6.

The flap fitting 12 described above can basically also be used for other configurations of furniture 1. So it is conceivable that flap 6 is made in one piece. In this case, the connection of the setting arm 13 to the fitting element 11 is configured displaceable by the connection arrangement 14 in order to compensate for differences in the pivot path of the setting arm 13 about the setting axis S1 and of the fitting element 11 about the hinge between the flap 6 and the top panel 3, which is not shown.

It is also conceivable that flap 6 is configured in one piece and that the hinge between flap 6 and top panel 3 is not needed. In this case, an additional control arm can be provided on the flap fitting 12, which is pivotably connected to the base element 15 and acts, together with the control arm 13, as a linkage mechanism. In some variations, flap fitting 12 takes over the function of both a lid stay and a lid hinge.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A flap fitting comprising:

a setting arm attached to a base element and pivotable about a setting axis between an open position and a closed position;

a toggle lever mechanism having a first lever and a second lever connected to each other pivotably about a pivot axis;

a spring element, wherein the spring element is configured to act on the first lever at a first link point spaced apart from the pivot axis and on the second lever at a second link point spaced apart from the pivot axis, the first link point and the second link point forcedly loaded by the spring element towards one another; and a setting contour arrangement with a setting contour and a guide element arranged between the first lever and the setting arm, wherein the guide element is movable along the setting contour and the setting arm is forcedly loaded in a direction of rotation about the setting axis at least in a partial section along the setting contour by the first lever via the setting contour arrangement.

2. The flap fitting according to claim 1, wherein the setting contour is formed on the first lever and the guide element is arranged on the setting arm at a distance from the setting axis.

3. The flap fitting according to claim 1, wherein the setting contour is arranged between the pivot axis and the first link point.

4. The flap fitting according to claim 1, wherein a distance of the first link point from the pivot axis is greater than a greatest distance of the setting contour from the pivot axis.

5. The flap fitting according to claim 1, wherein the guide element has a roller supported against the setting contour.

6. The flap fitting according to one of claim 1, wherein the spring element comprises a flat spring made from a flat material and the flat spring is elastically loaded between the base element and the setting arm in a plane of the flat material.

7. The flap fitting according to claim 6, wherein the flat spring is U-shaped in the plane of the flat material and forms a first leg and a second leg which merge into one another via a turn section, the first leg is rotatably connected to the base element with a first end and engages with the first end on the first link point of the toggle lever mechanism, and the second leg engages with a second end at the second link point of the toggle lever mechanism.

8. The flap fitting according to claim 7, wherein the first end has a convex partially cylindrical outer surface with which the flat spring is held in sliding contact with a complementarily formed concave partially cylindrical first sliding surface.

9. The flap fitting according to claim 7, wherein the second leg is linearly adjustable guided on the base element.

10. The flap fitting according to claim 9, wherein a flat second sliding surface is formed on the base element, against which the second end is held in sliding contact.

11. The flap fitting according to claim 10, wherein a sliding bearing element is arranged between the base element and the second end.

12. The flap fitting according to claim 10, wherein the first lever and the second lever of the toggle lever mechanism are pivotably movable relative to each other between the open position and the closed position and define an angle facing the flat second sliding surface, the angle being less than 180 degrees.

13. A flap fitting comprising:

a setting arm attached to a base element and pivotable about a setting axis between an open position and a closed position;

a toggle lever mechanism having a first lever and a second lever connected to each other pivotably about a pivot axis;

a spring element, wherein the spring element is configured to act on the first lever at a first link point spaced apart from the pivot axis and on the second lever at a second link point spaced apart from the pivot axis, the first link point and the second link point forcedly loaded by the spring element towards one another; and a setting contour arrangement with a setting contour and a guide element arranged between the first lever and the setting arm, wherein the setting contour is formed on the first lever, the guide element is arranged on the setting arm at a distance from the setting axis and movable along the setting contour, and the setting arm is forcedly loaded in a direction of rotation about the setting axis at least in a partial section along the setting contour by the first lever via the setting contour arrangement.

14. The flap fitting according to claim 13, wherein the setting contour is arranged between the pivot axis and the first link point and a distance of the first link point from the pivot axis is greater than a greatest distance of the setting contour from the pivot axis.

15. The flap fitting according to claim 14, wherein the guide element has a roller supported against the setting contour.

16. The flap fitting according to claim 15, wherein the spring element comprises a flat spring made from a flat material and the flat spring is elastically loaded between the base element and the setting arm in a plane of the flat material.

17. A flap fitting comprising:

a setting arm attached to a base element and pivotable about a setting axis between an open position and a closed position;

a toggle lever mechanism having a first lever and a second lever connected to each other pivotably about a pivot axis;

a spring element comprising a flat spring elastically loaded between the base element and the setting arm in a plane of the flat spring, wherein the spring element is configured to act on the first lever at a first link point spaced apart from the pivot axis and on the second lever at a second link point spaced apart from the pivot axis, the first link point and the second link point forcedly loaded by the spring element towards one another; and a setting contour arrangement with a setting contour and a guide element, wherein the guide element is arranged between the first lever and the setting arm and has a roller supported against the setting contour, the setting contour is formed on the first lever, the guide element is arranged on the setting arm at a distance from the setting axis and movable along the setting contour, and the setting arm is forcedly loaded in a direction of rotation about the setting axis at least in a partial section along the setting contour by the first lever via the setting contour arrangement.

18. The flap fitting according to claim 17, wherein:

the flat spring is U-shaped in the plane of the flat spring and forms a first leg and a second leg which merge into one another via a turn section, the first leg is rotatably connected to the base element with a first end and engages with the first end on the first link point of the toggle lever mechanism, and the second leg engages with a second end at the second link point of the toggle lever mechanism;

the first end has a convex partially cylindrical outer surface with which the flat spring is held in sliding contact with a complementarily formed concave partially cylindrical first sliding surface; and the second leg is linearly adjustable guided on the base element.

19. The flap fitting according to claim 18, wherein:

a flat second sliding surface is formed on the base element against which the second end is held in sliding contact;

a sliding bearing element is arranged between the base element and the second end; and between the open position and the closed position an angle of less than 180 degrees oriented in a direction towards the flat second sliding surface is formed between the first lever and the second lever of the toggle lever mechanism.

20. The flap fitting according to claim 1, wherein the guiding contour is disposed on a side of the first lever facing away from the second lever.

* * * * *